US008806718B2

(12) United States Patent
Elkasevic

(10) Patent No.: US 8,806,718 B2
(45) Date of Patent: Aug. 19, 2014

(54) DOMESTIC APPLIANCE HINGE ASSEMBLY WITH DOUBLE LINKAGE

(75) Inventor: Suad Elkasevic, Winterville, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/478,271

(22) Filed: May 23, 2012

(65) Prior Publication Data

US 2013/0312219 A1 Nov. 28, 2013

(51) Int. Cl.
*E05F 1/08* (2006.01)

(52) U.S. Cl.
USPC ..... 16/286

(58) Field of Classification Search
USPC ..... 16/286, 287, 257, 260, 261, 263, 323, 16/324; 126/191, 192, 194; 49/386, 389
See application file for complete search history.

(56) References Cited

U.S. PATENT DOCUMENTS

| | | | | |
|---|---|---|---|---|
| 3,450,125 | A * | 6/1969 | Hopkins | 126/191 |
| 6,035,848 | A * | 3/2000 | Ray et al. | 126/194 |
| 6,397,836 | B1 * | 6/2002 | Pelletier et al. | 126/194 |
| 6,453,510 | B1 * | 9/2002 | Cummins et al. | 16/343 |
| 6,719,383 | B2 | 4/2004 | Elick et al. | |
| 6,789,293 | B2 * | 9/2004 | Habegger et al. | 16/343 |
| 7,096,535 | B2 * | 8/2006 | Lin | 16/287 |
| 7,676,888 | B2 | 3/2010 | Vanini | |
| 2003/0056328 | A1 * | 3/2003 | Habegger et al. | 16/343 |
| 2003/0172920 | A1 * | 9/2003 | Gronbach | 126/197 |
| 2003/0213098 | A1 * | 11/2003 | Cummins et al. | 16/286 |
| 2006/0032019 | A1 * | 2/2006 | Kistner et al. | 16/286 |
| 2007/0101542 | A1 * | 5/2007 | Lee | 16/286 |
| 2008/0168618 | A1 | 7/2008 | Hottmann | |
| 2008/0189906 | A1 * | 8/2008 | Resnik et al. | 16/54 |
| 2008/0295283 | A1 | 12/2008 | Tice | |
| 2010/0018240 | A1 | 1/2010 | Hecht et al. | |
| 2010/0051067 | A1 | 3/2010 | Dalsing | |
| 2010/0109497 | A1 | 5/2010 | Blersch et al. | |
| 2010/0127606 | A1 | 5/2010 | Collene | |
| 2010/0139169 | A1 | 6/2010 | Patil et al. | |
| 2010/0148646 | A1 | 6/2010 | Bettinzoli | |
| 2010/0281650 | A1 | 11/2010 | Kleemann et al. | |
| 2011/0017191 | A1 | 1/2011 | White et al. | |
| 2011/0068671 | A1 | 3/2011 | Vanini | |

FOREIGN PATENT DOCUMENTS

| | | | |
|---|---|---|---|
| EP | 748987 | A1 * | 12/1996 |
| EP | 1039231 | A2 * | 9/2000 |

* cited by examiner

*Primary Examiner* — Chuck Mah
(74) *Attorney, Agent, or Firm* — James E. Howard; Andre Pallapies

(57) ABSTRACT

A hinge assembly for pivotably attaching a door to a domestic appliance is provided. The hinge assembly includes a hinge body; a damper having a central longitudinal axis; a first linkage member pivotably attached to the damper; a second linkage member pivotably attached to the damper; and a foot pivotably attached at a first end of the foot to the first and second linkage members, the foot being configured to engage at a second end of the foot a foot receiving portion of the domestic appliance such that the hinge body and the door pivot relative to the domestic appliance. The first and second linkage members are offset from and positioned on opposite sides of the central longitudinal axis of the damper.

12 Claims, 4 Drawing Sheets

DOMESTIC APPLIANCE HINGE ASSEMBLY WITH DOUBLE LINKAGE

FIELD OF THE INVENTION

The invention is directed to a hinge assembly for a domestic appliance. The hinge assembly has a double linkage between a damper and a hinge foot that provides improved operation.

An example of an application for the invention is a hinge assembly used with a door of a domestic appliance.

BACKGROUND OF THE INVENTION

Many domestic appliances, such as built in ovens, have one or more doors that swing open about a horizontal axis such that the door swings downward into an open position. Such a door is often heavy and uses springs of significant strength to counteract a portion of the weight of the door so that it is easier for a user to open and close the door. These springs often act to slam the door into the closed position after the door has passed a particular rotational position when moved upward toward the closed position. This slamming is undesirable for at least the reasons that it can make a loud noise, it can damage the appliance over time, and it gives the appearance of low quality. The result of such slamming is usually that the user continues to hold the door until it has reached the closed position.

To prevent the undesirable slamming, soft-close hinges can be employed. Soft-close hinges often include some type of damper that slows the movement of the door for a predetermined distance before the door reaches the closed position. This damping prevents the slamming of the door and results in a much more desirable appliance.

SUMMARY

Some dampers include a spring mounted inside a cylinder. The spring is often very long compared to its diameter in order to fit inside the cylinder. The damper can include a rod that moves relative to the cylinder when the damper is operated. A hinge assembly can include a damper, a spring, a hinge body, and a hinge foot. Often a domestic appliance, an oven for example, is provided with one hinge assembly on each side of an opening which is covered by the door. The hinge foot can be provided with an engagement portion that engages a foot receiving portion on the body of the domestic appliance. A linkage can be provided between the foot and the damper to define a predetermined motion of the foot relative to the damper during the opening and closing motions of the door. Due to the spring and damper forces acting on the foot and the foot receiving portion, the linkage between the foot and the damper can be subjected to differing forces at different points along the opening and closing motions. These differing forces can tend to twist the linkage and cause the opening and closing motions to be less smooth than desired.

The invention recognizes the existence of the above described differing forces and addresses this problem by providing a double linkage that holds the foot in the proper position relative to the damper.

Particular embodiments of the invention are directed to a hinge assembly for pivotably attaching a door to a domestic appliance having an appliance body. The hinge assembly includes a hinge body configured to attach to the door such that the hinge body is fixed relative to the door; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a first linkage member pivotably attached to the damper; a second linkage member pivotably attached to the damper; and a foot pivotably attached at a first end of the foot to the first and second linkage members, the foot being configured to engage at a second end of the foot a foot receiving portion of the domestic appliance such that the hinge body and the door pivot relative to the domestic appliance. The first and second linkage members are offset from and positioned on opposite sides of the central longitudinal axis of the damper.

Other embodiments of the invention are directed to a door assembly for pivotably attaching to a domestic appliance having an appliance body. The door assembly includes a door; and a hinge assembly for pivotably attaching the door to the domestic appliance. The hinge assembly includes a hinge body attached to the door such that the hinge body is fixed relative to the door; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a first linkage member pivotably attached to the damper; a second linkage member pivotably attached to the damper; and a foot pivotably attached at a first end of the foot to the first and second linkage members, the foot being configured to engage at a second end of the foot a foot receiving portion of the domestic appliance such that the hinge body and the door pivot relative to the domestic appliance. The first and second linkage members are offset from and positioned on opposite sides of the central longitudinal axis of the damper.

Other embodiments of the invention are directed to a domestic appliance that has an appliance body having a foot receiving portion; a door; and a hinge assembly pivotably attaching the door to the domestic appliance. The hinge assembly includes a hinge body attached to the door such that the hinge body is fixed relative to the door; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a first linkage member pivotably attached to the damper; a second linkage member pivotably attached to the damper; and a foot pivotably attached at a first end of the foot to the first and second linkage members, the foot being engaged at a second end of the foot to the foot receiving portion of the domestic appliance such that the hinge body and the door pivot relative to the domestic appliance. The first and second linkage members are offset from and positioned on opposite sides of the central longitudinal axis of the damper.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Many domestic appliances, such as, for example, built-in ovens, have a door that pivots relative to the body of the appliance to permit access to an internal space of the appliance. These doors are often heavy due to glass view panels, insulation, ventilating structure, and other elements. Springs are often used to reduce the effort needed from the user to close the door. These springs can be strong in order to exert a force that counteracts a large portion of the weight of a heavy door. The result of strong springs is often a slamming of the door once the door passes a particular point in the pivoting.

One or more dampers can be used to damp the closing action resulting from the strong springs to eliminate the slamming that can be caused by undamped springs. The dampers can be any type of damper including, but not limited to, gas filled or liquid filled dampers. Examples of fluid (gas and/or liquid) filled dampers have a cylinder that contains the fluid and may or may not include one or more orifices through with the fluid moves to create the damping force.

Some door hinge assemblies include both a spring and a damper. Some of these door hinge assemblies place the spring inside the damper cylinder to provide a compact assembly.

Figure 1:
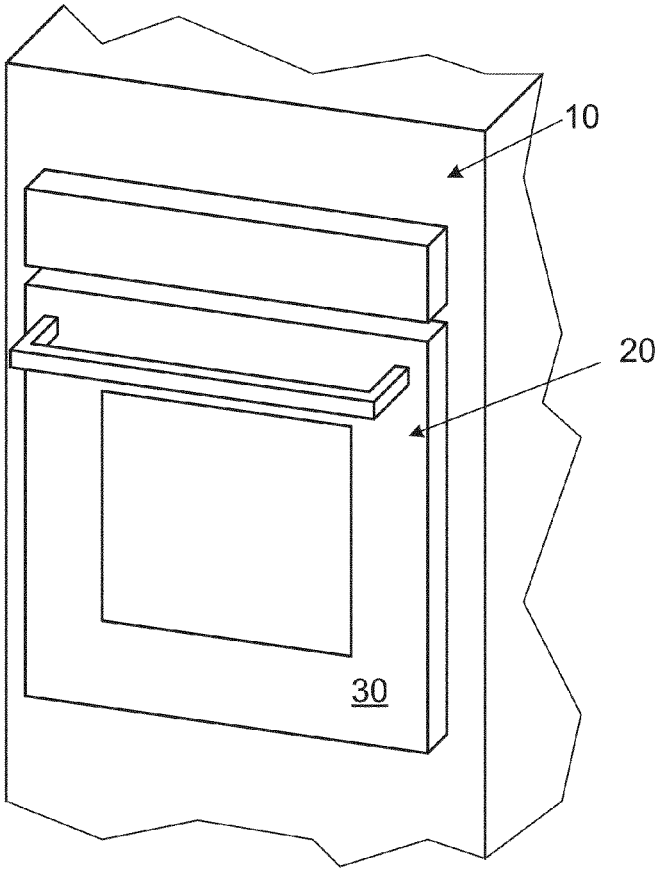
FIG. 1 is a perspective view of a domestic appliance in accordance with exemplary embodiments of the invention.

FIG. 1 shows an example of a domestic appliance 20 mounted in a cabinet 10. An example of a domestic appliance 20 is a cabinet-mounted oven. In this example, domestic appliance 20 includes a door 30 pivotably attached to a body of domestic appliance 20 to selectively open and close an interior space of domestic appliance 20. In some embodiments, door 30 is attached to the body of domestic appliance 20 by two hinge assemblies. Examples of the hinge assemblies are discussed below.

Figure 2:
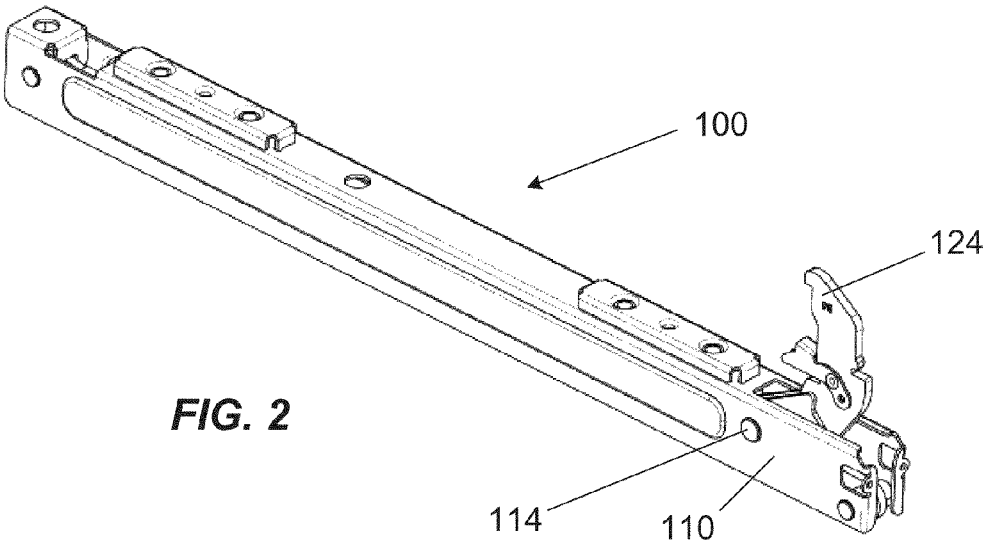
FIG. 2 is a perspective view of a hinge assembly in accordance with exemplary embodiments of the invention.
Figure 3:
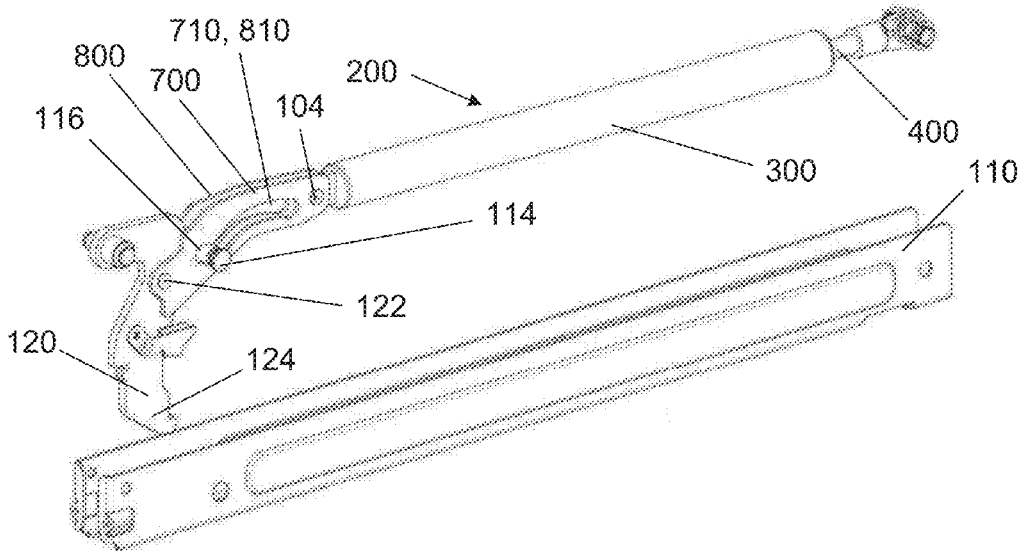
FIG. 3 is a partial exploded view of the hinge assembly shown in FIG. 2.

FIG. 2 shows a perspective view of a hinge assembly 100 that can be used to pivotably attach door 30 to the body of domestic appliance 20. In particular embodiments, two hinge assemblies 100 are used, one on each side of the opening of the interior space of domestic appliance 20. FIG. 3 shows hinge assembly 100 in a partially exploded view. A hinge assembly body 110 partially surrounds an assembly that includes a damper 200 and a foot 120.

Damper 200 includes a cylinder 300 and a rod 400. Rod 400 is partially inside cylinder 300 and partially outside cylinder 300 and moves in a reciprocating motion relative to cylinder 300. A damping force is applied to rod 400 as it moves relative to cylinder 300 and damps the motion of rod 400 relative to cylinder 300. This damping force can result from a fluid inside cylinder 300 being forced through at least one aperture when rod 400 moves, or from some other type of damping mechanism.

In this example, hinge assembly 100 is attached to door 30 such that hinge body 110 does not move relative to door 30. Also shown in FIGS. 2 and 3 is a foot 120 that is pivotably attached to damper 200 by a pin 122. An engagement end 124 of foot 120 engages a foot receiving feature (for example foot receiving portion 600 shown in FIG. 5) on domestic appliance 20 to attach door 30 to domestic appliance 20. Hinge assembly 100 and door 30 are then pivotable relative to the body of domestic appliance 20. Foot 120 is attached in this embodiment to the end of cylinder 300 by a first linkage member 700 and a second linkage member 800 such that foot 120 can pivot relative to cylinder 300. First and second linkage members 700, 800 are pivotably attached to cylinder 300 by a pin 104 and are pivotably attached to foot 120 by pin 122.

First linkage member 700 and second linkage member 800 have slots 710, 810, respectively, formed in them to receive a pin 114. FIG. 2 shows pin 114 in the operating position. FIG. 3 shows pin 114 removed from hinge body 110 to illustrate how slots 710, 810 engage pin 114. In this example, pin 114 includes a roller 116 that rotates around a center portion of pin 114 that is attached to hinge body 110 in order to provide a smooth rolling relationship between slots 710, 810 and pin 114.

Figure 4:
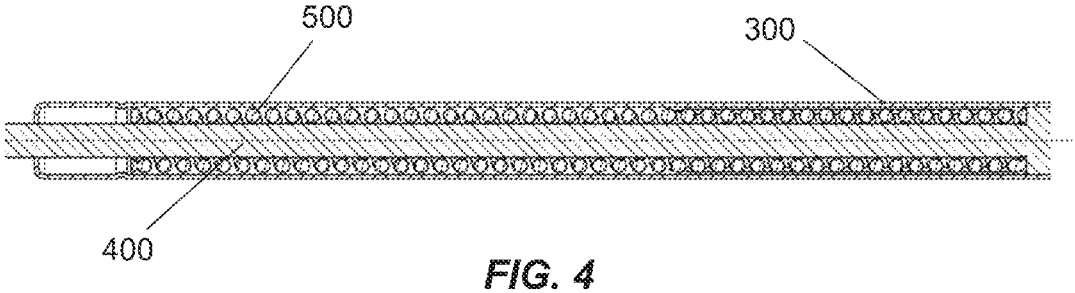
FIG. 4 is a sectional view of a damper in accordance with exemplary embodiments of the invention.

Embodiments of the invention include a coil spring positioned inside cylinder 300 as shown in FIG. 4. FIG. 4 shows rod 400 extending through the center of spring 500 and including a shoulder that supports the right side end of spring 500. As rod 400 is moved to the left in the figure, spring 500 is compressed. This movement corresponds to door 30 being moved from the closed position to the open position. As rod 400 is moved farther to the left, spring 500 becomes increasingly more compressed.

Figure 5:
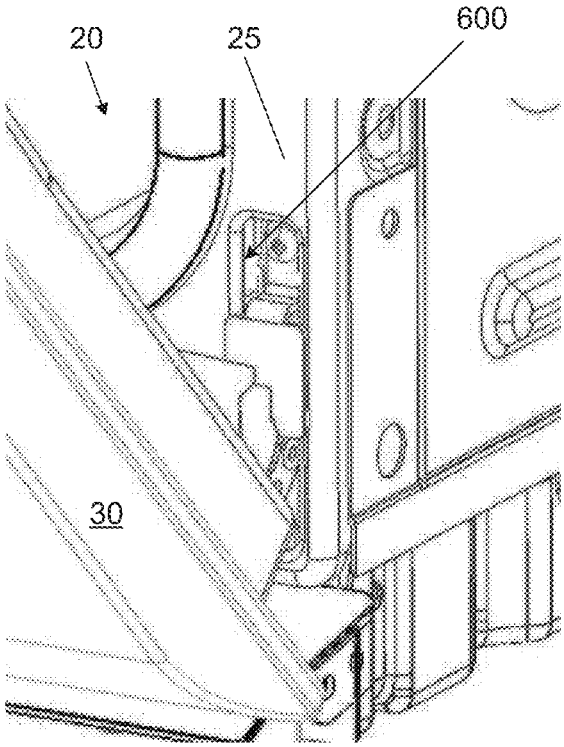
FIG. 5 is a perspective view of a domestic appliance in accordance with embodiments of the invention.

FIG. 5 shows door 30 attached to body 25 of domestic appliance 20, and in a partially opened position. Engagement end 124 of foot 120 is engaged with foot receiving portion 600 to keep door 30 attached to body 25.

Figure 6:
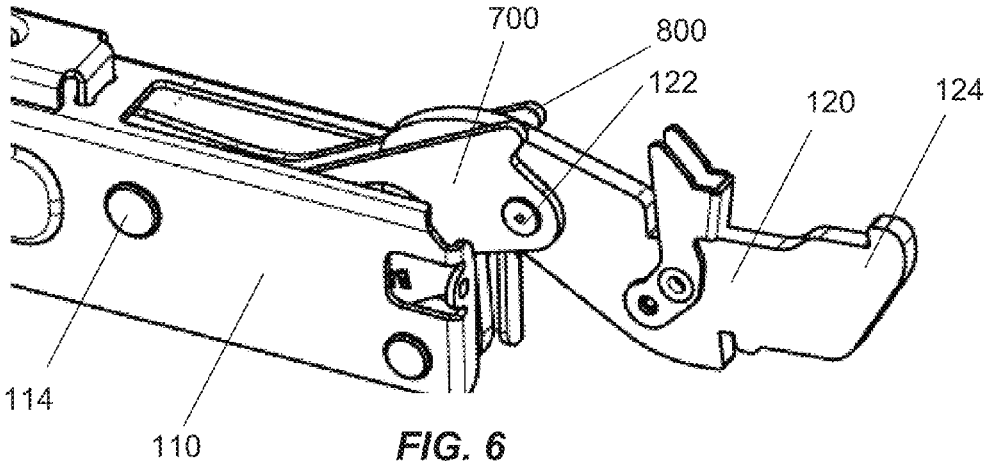
FIG. 6 is a perspective view of the end of the hinge assembly shown in FIG. 2 with the hinge foot and double linkage in an extended position.
Figure 7:
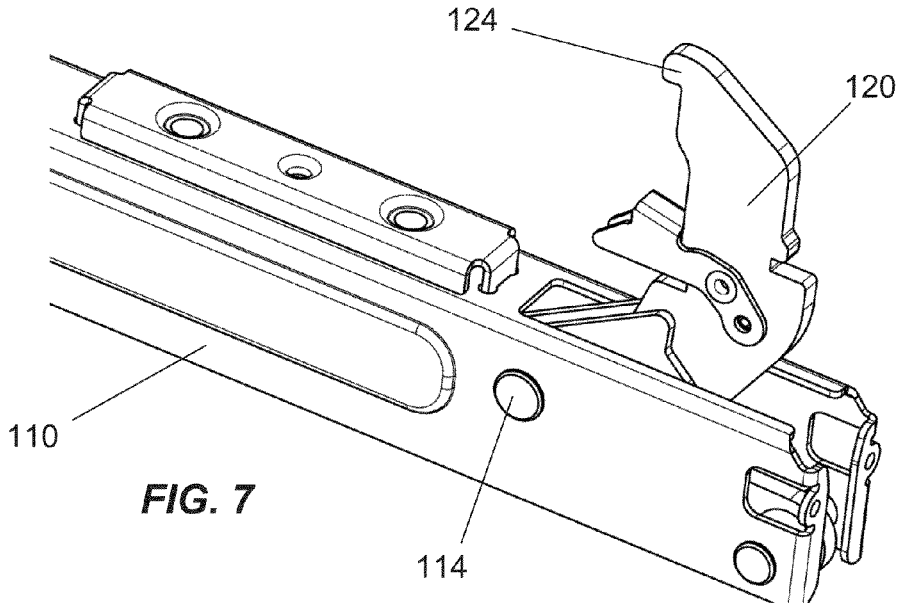
FIG. 7 is a perspective view of the end of the hinge assembly shown in FIG. 2 with the hinge foot and double linkage in a retracted position.
Figure 8:
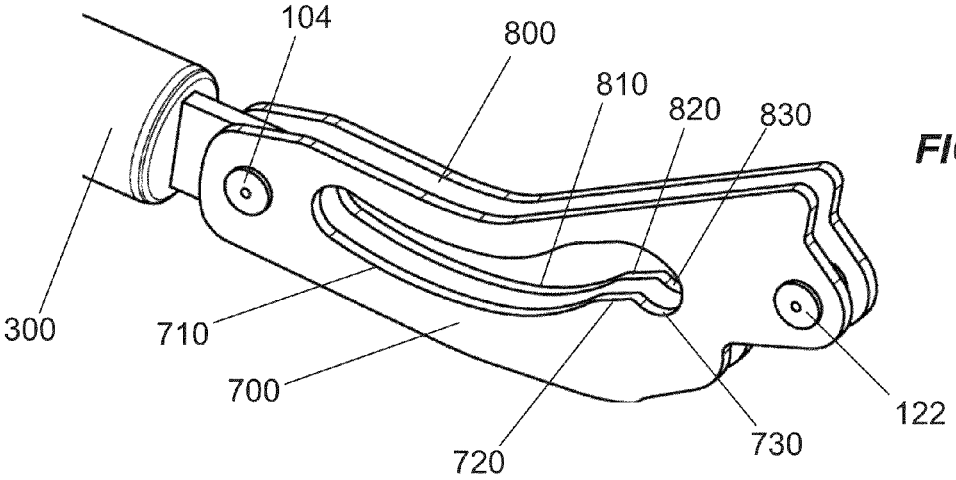
FIG. 8 is a perspective view of a double linkage in accordance with exemplary embodiments of the invention.

FIG. 6 shows foot 120 and first and second linkage members 700, 800 with foot 120 in an extended position. FIG. 7 shows foot 120 and first and second linkage members 700, 800 with foot 120 in a retracted position. These two Figures represent the two extremes of travel of slots 710, 810 relative to pin 114. FIG. 8 shows first and second linkage members 700, 800 out of hinge body 110 and with foot 120 removed so that the features of the linkage members can be seen more clearly. FIG. 8 shows slot 710 having a bump 720 that separates a closed-position resting spot 730 from the rest of slot 710. Similarly, slot 810 has a bump 820 that separates a closed-position resting spot 830 from the rest of slot 810. As door 30 is moved toward the closed position, pin 114 travels (relatively) in slots 710, 810 from left to right in FIG. 8 until it passes over bumps 720, 820 and comes to rest in closed-position resting spots 730, 830 when door 30 reaches the closed position. The curved shape of slots 710, 810 provide a predetermined motion of door 30 relative to appliance body 25 during the opening and closing operations.

Having two linkage members instead of one result in a simple, inexpensive design that provides a wider effective bearing surface for pin 114 while also providing a linkage that is centered on a plane that includes the central longitudinal axis of damper 200. By being centered on a plane that includes the central longitudinal axis of damper 200, the linkage provides a stable connection between foot 120 and damper 300. This stable linkage is important to the smooth operation of a damped hinge more so than to the operation of a non-damped hinge because the damping forces in conjunction with the curved shape of slots 710, 810 subject the linkage to different forces at different points of travel of pin 114 through slots 710, 810. The wider bearing surface also provides resistance to the linkage twisting relative to pin 114, which further improves the smoothness of operation. By providing two plate-like linkage members, fabrication costs are reduced as compared to a machining the required shape out of one piece of material.

It is noted that in domestic appliances that have two hinge assemblies, particularly when the hinge assemblies are located or different sides of a door opening, slightly different spring characteristics, slightly different damper characteristics, and/or uneven wear of the spring, damper, or other components, can cause the hinge assemblies to operate with different force and damping characteristics. Such differences can result unequal forces acting on the door of the domestic appliance. These unequal forces can act to twist or skew the door relative to the appliance body. The double linkage system of the invention resists these forces as well as the damper/spring forces discussed above.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge assembly for pivotably attaching a door to a domestic appliance having an appliance body, the hinge assembly comprising:

a hinge body configured to attach to the door such that the hinge body is fixed relative to the door;

a pin attached to the hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper;

a first linkage member pivotably attached to the damper;

a second linkage member pivotably attached to the damper; and a foot pivotably attached at a first end of the foot to the first and second linkage members, the foot being configured to engage at a second end of the foot a foot receiving portion of the domestic appliance such that the hinge body and the door pivot relative to the domestic appliance, wherein the first and second linkage members are offset from and positioned on opposite sides of the central longitudinal axis of the damper, the first linkage member has a first slot which receives the pin such that movement of the first linkage member relative to the hinge body is constrained by the pin moving in the first slot, the first slot being completely closed with no open section, the second linkage member has a second slot which receives the pin such that movement of the second linkage member relative to the hinge body is constrained by the pin moving in the second slot, the second slot being completely closed with no open section, the first slot includes a first bump and a first closed-position resting spot, the first bump being between the first closed-position resting spot and the remainder of the first slot, and the first closed-position resting spot being at an end of the first slot, the second slot includes a second bump and a second closed-position resting spot, the second bump being between the second closed-position resting spot and the remainder of the second slot, and the second closed-position resting spot being at an end of the second slot, and the pin is located in the first and second closed-position resting spots when the rod is in a maximum retracted position relative to the cylinder.

2. The assembly of claim 1, wherein the first linkage member is a planar member, and second linkage member is a planar member.

3. The assembly of claim 2, wherein the first linkage member is parallel to the second linkage member.

4. The assembly of claim 3, wherein the pin has a main pin body and an outer roller that rotates relative to the main pin body, and any contact between the first and second slots and the pin is between the first and second slots and the outer roller.

5. A door assembly for pivotably attaching to a domestic appliance having an appliance body, the door assembly comprising:

a door; and a hinge assembly for pivotably attaching the door to the domestic appliance, the hinge assembly comprising:

a hinge body attached to the door such that the hinge body is fixed relative to the door;

a pin attached to the hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper;

a first linkage member pivotably attached to the damper;

a second linkage member pivotably attached to the damper; and a foot pivotably attached at a first end of the foot to the first and second linkage members, the foot being configured to engage at a second end of the foot a foot receiving portion of the domestic appliance such that the hinge body and the door pivot relative to the domestic appliance, wherein the first and second linkage members are offset from and positioned on opposite sides of the central longitudinal axis of the damper, the first linkage member has a first slot which receives the pin such that movement of the first linkage member relative to the hinge body is constrained by the pin moving in the first slot, the first slot being completely closed with no open section, and the second linkage member has a second slot which receives the pin such that movement of the second linkage member relative to the hinge body is constrained by the pin moving in the second slot, the second slot being completely closed with no open section, the first slot includes a first bump and a first closed-position resting spot, the first bump being between the first closed-position resting spot and the remainder of the first slot, and the first closed-position resting spot being at an end of the first slot, the second slot includes a second bump and a second closed-position resting spot, the second bump being between the second closed-position resting spot and the remainder of the second slot, and the second closed-position resting spot being at an end of the second slot, and the pin is located in the first and second closed-position resting spots when the rod is in a maximum retracted position relative to the cylinder.

6. The assembly of claim 5, wherein the first linkage member is a planar member, and second linkage member is a planar member.

7. The assembly of claim 6, wherein the first linkage member is parallel to the second linkage member.

8. The assembly of claim 7, wherein the pin has a main pin body and an outer roller that rotates relative to the main pin body, and any contact between the first and second slots and the pin is between the first and second slots and the outer roller.

9. A domestic appliance, comprising:

an appliance body having a foot receiving portion;

a door; and a hinge assembly pivotably attaching the door to the domestic appliance, the hinge assembly comprising:

a hinge body attached to the door such that the hinge body is fixed relative to the door;

a pin attached to the hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper;

a first linkage member pivotably attached to the damper;

a second linkage member pivotably attached to the damper; and a foot pivotably attached at a first end of the foot to the first and second linkage members, the foot being engaged at a second end of the foot to the foot receiving portion of the domestic appliance such that the hinge body and the door pivot relative to the domestic appliance, wherein the first and second linkage members are offset from and positioned on opposite sides of the central longitudinal axis of the damper, the first linkage member has a first slot which receives the pin such that movement of the first linkage member relative to the hinge body is constrained by the pin moving in the first slot, the first slot being completely closed with no open section, and the second linkage member has a second slot which receives the pin such that movement of the second linkage member relative to the hinge body is constrained by the pin moving in the second slot, the second slot being completely closed with no open section, the first slot includes a first bump and a first closed-position resting spot, the first bump being between the first closed-position resting spot and the remainder of the first slot, and the first closed-position resting spot being at an end of the first slot, the second slot includes a second bump and a second closed-position resting spot, the second bump being between the second closed-position resting spot and the remainder of the second slot, and the second closed-position resting spot being at an end of the second slot, and the pin is located in the first and second closed-position resting spots when the rod is in a maximum retracted position relative to the cylinder.

10. The domestic appliance of claim 9, wherein the first linkage member is a planar member, and second linkage member is a planar member.

11. The domestic appliance of claim 10, wherein the first linkage member is parallel to the second linkage member.

12. The domestic appliance of claim 11, wherein the pin has a main pin body and an outer roller that rotates relative to the main pin body, and any contact between the first and second slots and the pin is between the first and second slots and the outer roller.

* * * * *